US005976100A

United States Patent [19]

Greenawalt

[11] Patent Number: 5,976,100

[45] Date of Patent: Nov. 2, 1999

[54] CUSTOM ORTHOTIC FOOT SUPPORT WITH MAGNETIC THERAPY

[76] Inventor: Kent S. Greenawalt, 5056 Hunting Hills Sq., Roanoke, Va. 24014

[21] Appl. No.: 09/129,054

[22] Filed: Aug. 4, 1998

[51] Int. Cl.[6] ..... A61F 13/00; A43B 3/12; A43B 13/38

[52] U.S. Cl. ..... 602/66; 36/43; 36/44

[58] Field of Search ..... 602/10, 66; D24/200, D24/213, 192; 128/893, 894; 36/91, 92, 43, 44, 140, 141, 145, 152, 166, 173, 181; 600/9, 15; 601/15, 22

[56] References Cited

U.S. PATENT DOCUMENTS

| | | | |
|---|---|---|---|
| 4,033,054 | 7/1977 | Fukuoka | 36/91 X |
| 4,841,647 | 6/1989 | Turucz | 36/43 |
| 5,233,768 | 8/1993 | Humphreys | 36/44 |
| 5,551,173 | 9/1996 | Chambers | 36/44 |

OTHER PUBLICATIONS

Copy of pp. 8–79, 110–129 and 180–208 from book entitled The Pain Relief Breakthrough—The Power of Magnets by Julian Whitake, M.D. and Brenda Adderly, M.H.A., Copyright 1998 by Affinity Communications Corp. ISBN 0316–60193–4 The Library of Congress Catalog Card No. 97–76355.

*Primary Examiner*—Richard J. Apley
*Assistant Examiner*—Kim M. Lee
*Attorney, Agent, or Firm*—Henderson & Sturm

[57] ABSTRACT

A custom-made orthotic support unit including specific orthotic magnet elements formed into a unitary arch support for insertion, into and/or onto contemporary footwear for providing both postural corrections and magnetic therapy for the wearer.

6 Claims, 2 Drawing Sheets

CUSTOM ORTHOTIC FOOT SUPPORT WITH MAGNETIC THERAPY

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

AUTHORIZATION PURSUANT TO 37 C.F.R. §1.71 (d) (e)

A portion of the disclosure of this patent document, including appendices, may contain material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates generally to footwear and specifically to custom-made footwear incorporating orthotics and magnets.

2. Background Art

It is common knowledge that the nervous system of the human body includes a membrane surrounding each nerve fiber, which membrane is polarized, or has opposite electrical charges on opposite sides. Positive ions, or positively charged particles, are located outside the membrane. Inside the membrane are negatively charged particles. It is further known that the polarized membranes enable the nerves to pass impulses between different parts of the brain and spinal chord, and between the sensory and motor neurons.

Concurrently, it is commonly known that magnets such as permanent magnets of a bar-type have opposed poles where the magnetism is the strongest and which set up a magnetic field about the magnet, the field at one pole applying a force away from the pole, and the field at the opposite pole applying a force toward that opposite pole. In addition to applying force at the magnetic poles, the magnetic field also applies force on moving electric charges, such as the moving impulses of the human nervous system.

That part of medical science that studies and relates to different ways of helping normal body functions to restore health includes the field of physical therapy. Physical therapy does not use drugs, medicines or the like, but uses only physical means such as heat, cold, water, electricity and change of climate.

It is also well recognized in the medical profession and particularly by podiatrists and chiropractors, that many health problems related to the spine and specific joints can be corrected by properly constructed foot supports. To this area of orthopedics for the correction of the skeletal system in persons of any age, the application of magnetics for enhanced and synergistic electromagnetic therapy is combined.

DISCLOSURE OF THE INVENTION

The present invention relates to a custom-made orthotic support unit which comprises specific orthotic elements and magnetic elements formed into a unitary arch support for insertion into or as a part of contemporary footwear for providing both postural corrections and magnetic therapy for the wearer.

More particulary, the invention comprises a sole having an outline in plan of the foot of the wearer, with a heel portion and a forward portion; a prescribed orthotic unit which may include a plurality of orthotic elements such as arch and heel supports; a pair of bar magnets disposed longitudinally of the sole to be beneath the arch and instep areas of the foot, the magnetic fields of the magnets being reversed from each other, and a covering for the orthotic and magnet elements whereby to form with the sole a unitary custom-made foot support.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
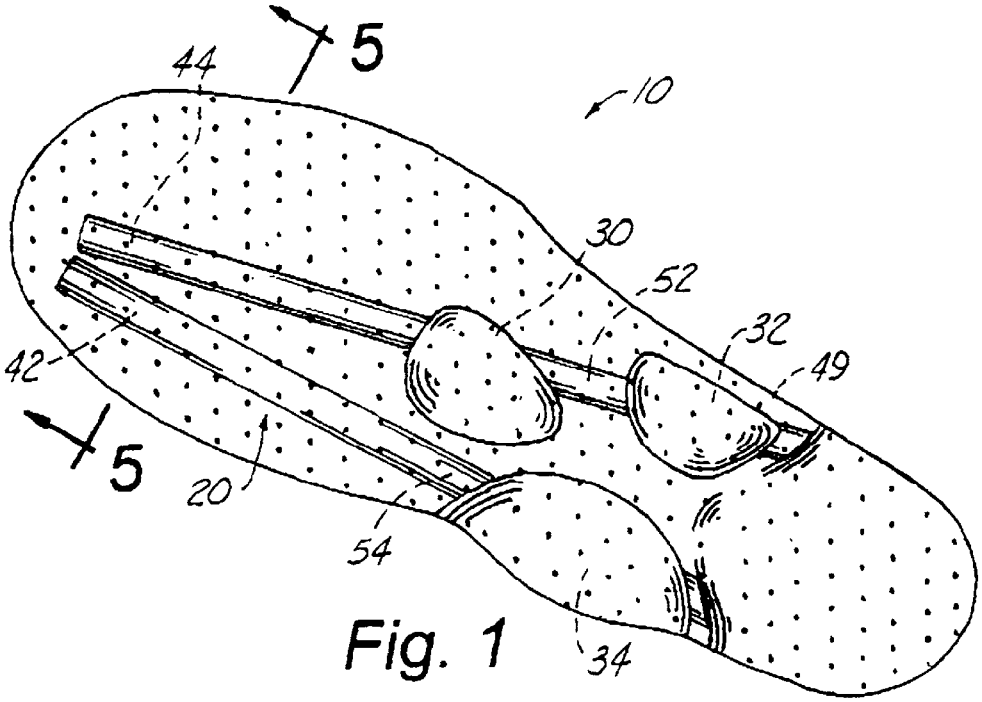
FIG. 1 comprises a plan view of a foot support unit of the invention for the right foot of the wearer, the unit (not shown) for the left foot being a mirror image of FIG. 1.
Figure 2:
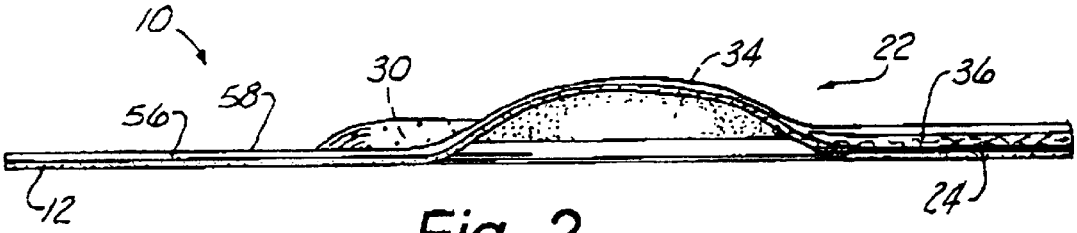
FIG. 2 is a side elevational view taken from the left side of the unit of FIG. 1.
Figure 3:
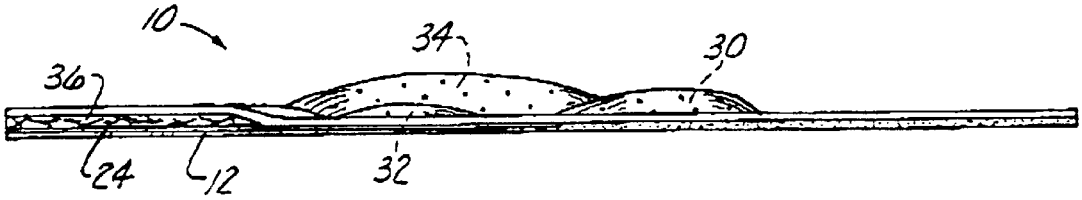
FIG. 3 is a side elevational view taken from the right side of the unit of FIG. 2.

Referring now to FIGS. 1–4, the embodiment of the invention depicted includes a foot support unit (10) for placement into a shoe, onto a sandal, or as an integral part of same, and comprises generally a sole (12) of a thin layer of leather having the outline of the foot of the wearer so as to support the entire foot, and of a thickness as predetermined for its use, the sole (12) having a heel portion (14) and a forward portion (16); an orthotic unit (18) adhered to the sole (12) and prescribed to the wearer's foot; a magnetic unit (20) adhered also to the sole (12) and primarily to the forward portion (16) for providing magnetic therapy to the wearer's foot; and a covering unit (22) disposed above the orthotic unit (18) and the magnetic unit (20). The covering unit (22) cooperates with the sole (12), the orthotic unit (18) and the magnetic unit (20) to form the unitary foot support (10).

More particularly, the orthotic unit (18) comprises a semi-flexible guard element (24) of electrical insulation material and having a U-shaped outline similar to the outline of the heel portion (14) of the sole (12) and to the upper surface (26) of which the guard (24) is adhered, with the forward edge (28) of the guard (24) extended transversely across the sole (12). The orthotic unit (18) comprises further sponge rubber arch supports (30), (32), (34) formed according to the prescribed arch support needs of the individual for whom the foot support (10) is custom made, the supports (30), (32), (34) adhered to the sole upper surface (26) or to the upper surface (40) of the guard (24) depending upon the custom needs of the wearer. Additionally, a heel pad (36), made of a polyurethane foam providing a higher degree of shock absorption than the arch support elements (30), (32), (34), and of a curved shape to fit over the rear portion (38) of the guard (24) so as to be aligned with it and the heel portion (14) of the sole (12), is adhered to the upper surface (40) of the guard (24). The forward edge (41) of the pad (36) may have an inverted V-shape as viewed from the rear of the pad (36).

The magnetic unit (20) includes a pair of flexible, elongated, commercially available magnets (42), (44) (FIG. 4) of the type used, for example, to hold materials to the front of refrigerators. The magnets (42), (44) are identical in size and shape, each with a thickness of from 15 mil to 60 mil, with the range of 30 mil to 60 mil preferred, and with a preferred strength of from 400 gauss to 750 gauss. The energy level of the magnetic material is 0.750 mega gauss oersted.

Figure 4:
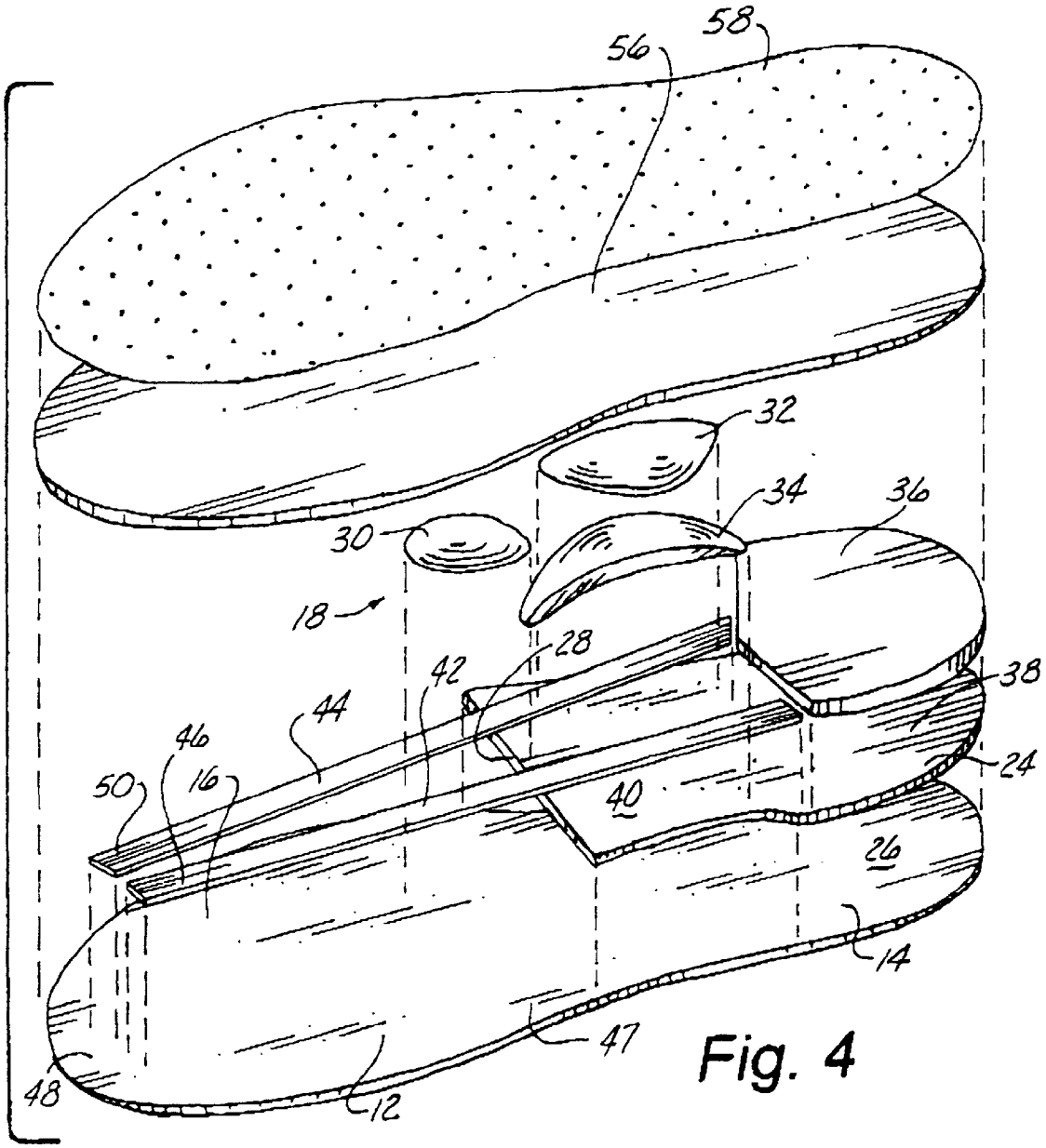
FIG. 4 is an exploded view in perspective of the foot support unit of FIG. 1.
Figure 5:
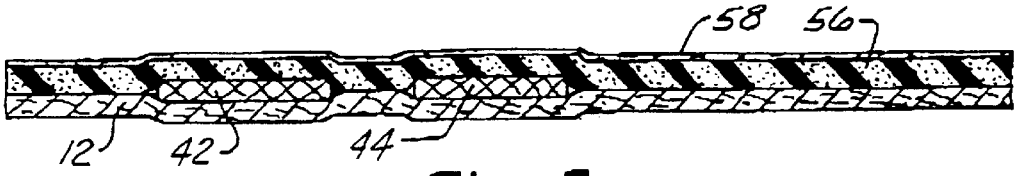
FIG. 5 is a cross sectional view as taken along 5—5 of FIG. 1.

As seen in FIGS. 4 and 5, one magnet (42) is placed, in plan along one side (47) of the sole (12), with its length longitudinal of the sole (12) so as to be disposed below the arch of the wearer, with the forward end (46) beginning from the toe (48) of the sole (12) and extended toward the heel portion (14) of the sole (12) and is disposed above the electrically insulated guard (24). The other magnet (44) also has a forward end (50) placed alongside the other magnet forward end (46), but with its length disposed angularly across the sole (12) from the magnet (42) toward the opposite side (49) of the sole (12) so as to form a V-shape with the other magnet (42). Again, the rear end (52) of the magnet (44)—similar to the rear end (54) of the magnet (42), extends toward the sole heel portion (14) and is placed above the guard (24).

The outer magnet (42) is placed such that its magnetic field exerts a force upwardly and toward the foot of the wearer, while the other diagonal magnet (44) is turned upside down and placed such that its magnetic field exerts a force, or pull, downwardly of the foot of the wearer, the pull strength being 100 pounds per square foot.

The covering unit (22) includes a thin layered pad (56) (FIG. 4) of polyurethane and a thinner layer (58) of perforated leather or the like disposed above the pad (56). Both pad (56) and layer (58) have an outline similar to that of the sole (12), with the pad (56) and layer (58) bonded together and adhered in any conventional manner with the remaining elements to form a unitary foot support (10).

Thus, from this description, it may readily be seen that the foot support unit (10) of this invention provides not only the corrective support of orthotics, but also the energizing effect of magnets for enhanced physical therapy of the wearer.

What is claimed is:

1. A foot support assembly designed for placement with footwear in supporting engagement with a bottom of a foot, comprising:

means forming a sole having an outline in plan of the foot of the wearer, with a heel portion and a forward portion;

an orthotic unit prescribed specially for a foot of the wearer adhered to said sole means;

magnetic means adhered to said sole means;

means forming a covering secured to said sole means over said orthotic unit and said magnetic means;

and further wherein said magnetic means includes a first magnetic field disposed along the arch side of said sole and a second magnetic field separate from and disposed angularly of said first magnetic field toward an opposite side of said sole; and further wherein said one field exerts a force directed upwardly toward the foot of the wearer, and the other field exerts a force directed downwardly from the foot of the wearer.

2. The assembly as in claim 1, and further wherein said one field is derived from a first magnet, and said other field derives from a second magnet.

3. The assembly as in claim 2, and further wherein the thickness of each of said magnets has a range of 30–60 mil.

4. The assembly as in claim 3, and further wherein the field strength of each of said magnets has a range of 400–750 gauss.

5. The assembly as in claim 4, and further wherein the energy level of each of said magnets is 0.750 mega gauss oersted.

6. The assembly as in claim 5, and further wherein said other field magnet has a pull strength of 100 lbs. per square foot.

* * * * *